US007013938B2

(12) United States Patent
Liu

(10) Patent No.: US 7,013,938 B2
(45) Date of Patent: Mar. 21, 2006

(54) SHIFTABLE ROLLING FEED DEVICE FOR A WOOD PLANING MACHINE

(75) Inventor: Chin Yuan Liu, Taichung (TW)

(73) Assignee: Shinmax Industry Co., Ltd., Taichung (TW)

( * ) Notice: Subject to any disclaimer, the term of this patent is extended or adjusted under 35 U.S.C. 154(b) by 269 days.

(21) Appl. No.: 10/752,065

(22) Filed: Jan. 6, 2004

(65) Prior Publication Data

US 2004/0250888 A1 Dec. 16, 2004

(30) Foreign Application Priority Data

Jan. 8, 2003 (TW) ..... 92200313 U

(51) Int. Cl.
*B27C 1/00* (2006.01)

(52) U.S. Cl. ..... 144/117.1; 144/130; 409/157; 409/159; 74/22 A; 74/22 R; 74/27; 74/63; 74/473.1

(58) Field of Classification Search ..... 144/114.1, 144/117.1, 117.4, 129, 130; 409/157, 159; 74/22 A, 22 R, 25, 27, 34, 63, 469, 473.1, 74/473.3

See application file for complete search history.

(56) References Cited

U.S. PATENT DOCUMENTS 4,886,099 A * 12/1989 Ferreira de Abreu .... 144/246.1
5,957,173 A * 9/1999 Garcia ..... 144/117.1
5,988,239 A * 11/1999 Chen ..... 144/129
6,289,950 B1 * 9/2001 Chiang ..... 144/117.1
6,557,599 B1 5/2003 Liao

* cited by examiner

*Primary Examiner*—Derris H. Banks
*Assistant Examiner*—Shelley Self
(74) *Attorney, Agent, or Firm*—Frommer Lawrence & Haug LLP:; Ronald R. Santucci

(57) ABSTRACT

A drive shiftable rolling feed device includes front and rear feed rollers mounted on a support carriage of a wood planing machine for feeding a workpiece, a reduction gear train disposed to convert a primary drive of a cutter shaft into two reduction drives and coupled to two spaced-apart driven gears to deliver the two reduction drives, a clutch actuating shaft surrounded by the driven gears and having a coupling segment which is movable between first and second positions, and a clutch member disposed to couple the coupling segment to one of the driven gears when the coupling segment is in a corresponding one of the first and second positions such that the coupled driven gear can be rotated with a rotational drive that is transmitted to the feed rollers.

9 Claims, 9 Drawing Sheets

SHIFTABLE ROLLING FEED DEVICE FOR A WOOD PLANING MACHINE

CROSS-REFERENCE TO RELATED APPLICATION

This application claims priority of Taiwanese Application No. 092200313, filed on Jan. 8, 2003.

BACKGROUND OF THE INVENTION

1. Field of the Invention

This invention relates to a rolling feed device for a wood planing machine, more particularly to a drive shiftable rolling feed device with feed rollers capable of rotation at two different speeds.

2. Description of the Related Art

A conventional wood planing machine as disclosed in U.S. Pat. No. 6,557,599, includes a support carriage mounted movably on a mounting frame, a cutter shaft rotatably mounted on the support carriage and driven by a motor, and front and rear feed rollers mounted on the support carriage at two opposite sides of the cutter shaft for feeding a workpiece. A reduction gear train is disposed to transmit a rotational force of the cutter shaft to a first transmitting shaft with two first and second gears mounted thereon so as to deliver first and second reduction drives to the gears. Third and fourth gears are mounted on a second transmitting shaft, and are axially movable such that the second transmitting shaft can be rotated with a first rotational drive when the third gear meshes with the first gear, or with a second rotational drive when the fourth gear meshes with the second gear. A sprocket-and-chain mechanism is disposed to transmit the first or second rotational drive of the second transmitting shaft to the front and rear feed rollers. A shifting member has a cam member which transforms a rotational force of a knob into a translation force to move the third and fourth gears on the second transmitting shaft. However, the third and fourth gears are moved every time when the speed of the rollers is shifted, thereby resulting in inconvenient operation.

SUMMARY OF THE INVENTION

The object of the present invention is to provide a drive shiftable rolling feed device with feed rollers, the rotational speed of which can be shifted conveniently by turning an actuating lever.

According to this invention, the drive shiftable rolling feed device includes front and rear feed rollers adapted to be mounted on a support carriage of a wood planing machine at two opposite sides of a cutter shaft in a transverse direction. Each of the front and rear feed rollers is rotatable about a roller axis in a longitudinal direction. First and second driven gears are adapted to be mounted on and are rotatable relative to the support carriage about a driving axis parallel to the roller axis, and are spaced apart from each other along the driving axis. A reduction gear train is adapted to convert a primary drive of the cutter shaft into first and second reduction drives. The reduction gear train is coupled to the first and second driven gears to deliver the first and second reduction drives to the first and second driven gears, respectively. A clutch actuating shaft is adapted to be mounted rotatably on the support carriage, extends along the driving axis, and is surrounded by the first and second driven gears. The clutch actuating shaft includes a coupling segment which is movable along the driving axis relative to the support carriage, and an actuated end opposite to the coupling segment along the driving axis. The actuated end is actuated to move the coupling segment along the driving axis between first and second positions. A clutch member is disposed to couple the coupling segment to the first driven gear when the coupling segment is in the first position so as to transmit the first reduction drive to drive the clutch actuating shaft to rotate with a first rotational drive, and to couple the coupling segment to the second driven gear when the coupling segment is in the second position so as to transmit the second reduction drive to drive the clutch actuating shaft to rotate with a second rotational drive. A drive transmitting member is disposed to transmit the first or second rotational drive of the clutch actuating shaft to the front and rear feed rollers. A shifting member is coupled to the actuated end to shift the coupling segment between the first and second positions.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
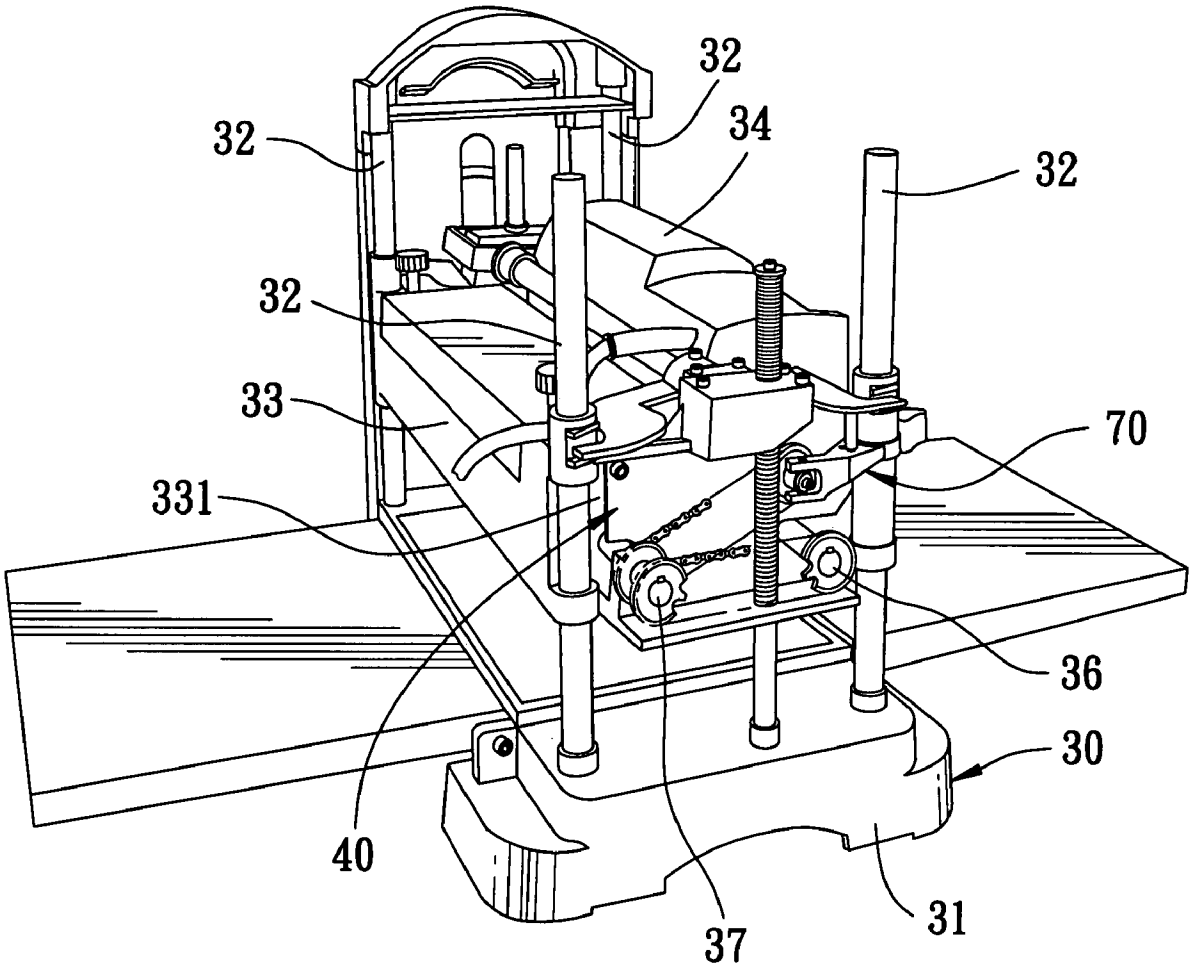
FIG. 1 is a perspective view of the preferred embodiment of a drive shiftable rolling feed device according to this invention, shown together with a wood planing machine.

Referring to FIG. 1, the preferred embodiment of a drive shiftable rolling feed device according to the present invention is shown to be mounted on a wood planing machine. The machine has a mounting frame 30 which includes a base 31 and four upright posts 32 that extend in an upright direction from the base 31 to define right and left frame sides of the mounting frame 30 which are spaced apart from each other in a longitudinal direction, a support carriage 33 that is mounted on the four upright posts 32 and that is movable in the upright direction, a motor 34 with an output shaft (not shown) that is disposed on the support carriage 33, and a cutter shaft 35 (see FIG. 4) that is rotatably mounted on the support carriage 33, that extends in the longitudinal direction, and that is driven by the output shaft of the motor 34 so as to deliver a primary drive.

With reference to FIGS. 1 to 4, the device of this invention is shown to comprise front and rear feed rollers 36,37, a mounting plate member 40, a reduction gear train 60, first and second driven gears 67,68, a clutch actuating shaft, a clutch member, a drive transmitting member 100, a shifting member 70, and a shaft positioning member 90.

The front and rear feed rollers 36,37 are mounted on the support carriage 33 at two opposite sides of the cutter shaft 35 in a transverse direction relative to both the longitudinal direction and the upright direction. Each of the front and rear feed rollers 36,37 is rotatable about a roller axis in the longitudinal direction so as to facilitate feeding of a workpiece.

The mounting plate member 40 includes an inside plate 41 secured on a lateral plate 331 of the support carriage 33, and an outside plate 42 spaced apart from the inside plate 41 in the longitudinal direction by screw bolts 43 fastening therebetween.

The reduction gear train 60 includes first and second transmitting shafts 51,52, and first, second, third, fourth, fifth and sixth gears 61,62,63,64,65,66 to convert the primary drive of the cutter shaft 35 into first and second reduction drives. In particular, the first and second transmitting shafts 51,52 are mounted rotatably and respectively on the inside and outside plates 41,42 about first and second transmitting axes, respectively, which are parallel to the roller axis. The first gear 61 is coupled to the cutter shaft 35, and meshes with the second gear 62 which is coupled to the first transmitting shaft 51 so as to rotate the first transmitting shaft 51 about the first transmitting axis. The third gear 63 is coupled to the first transmitting shaft 51, and meshes with the fourth gear 64 which is coupled to the second transmitting shaft 52 so as to rotate the second transmitting shaft 52 about the second transmitting axis. The fifth and sixth gears 65,66 are coupled to the second transmitting shaft 52 to transmit the first and second reduction drives.

The first and second driven gears 67,68 are disposed between the inside and outside plates 41,42, and mesh with the fifth and sixth gears 65,66, respectively, to rotate about a driving axis parallel to the roller axis. The first and second driven gears 67,68 are spaced apart from each other along the driving axis. Thus, the first and second reduction drives of the reduction gear train 60 can be delivered to the first and second driven gears 67,68, respectively.

Figure 3:
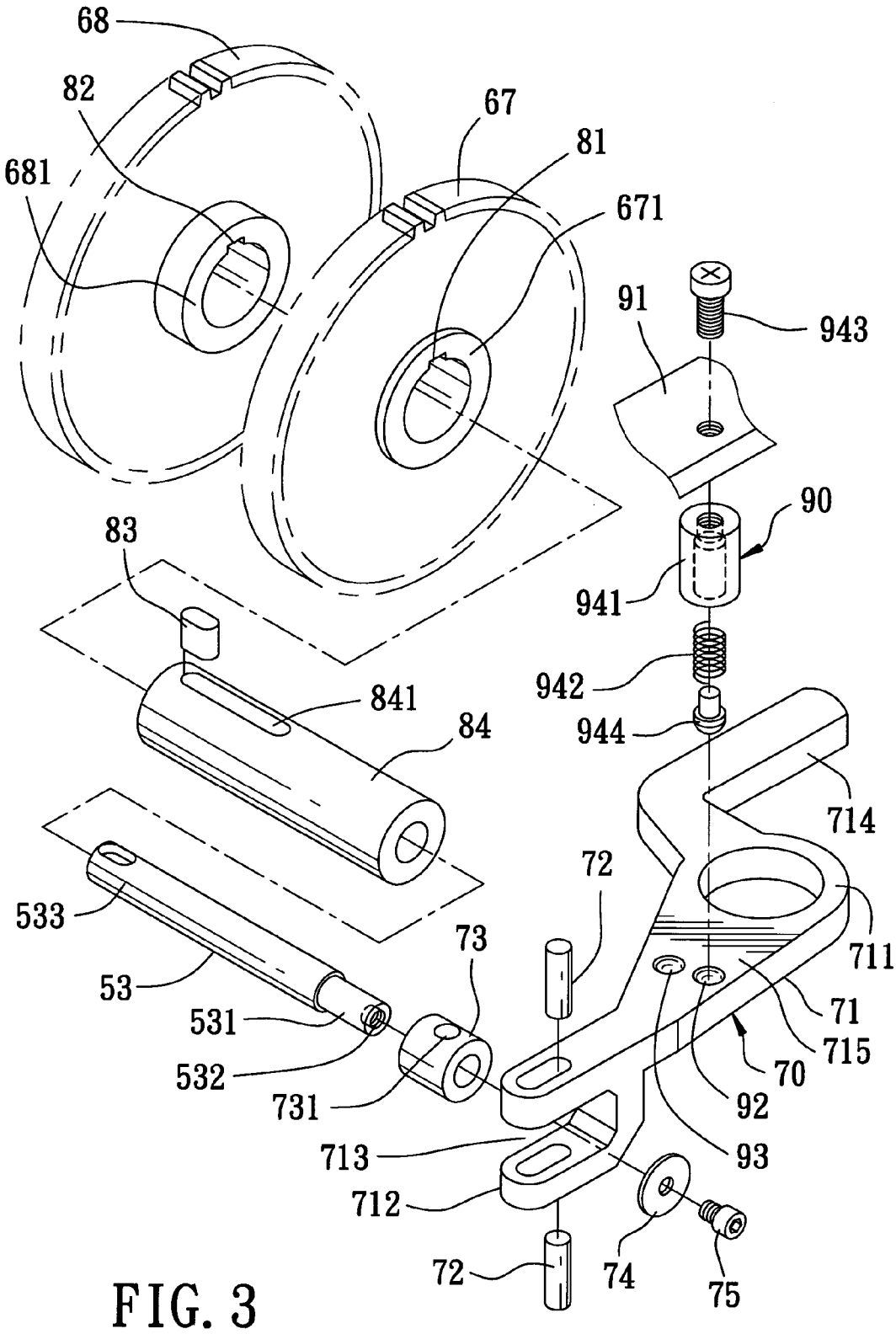
FIG. 3 is an exploded perspective view of a portion of the preferred embodiment.
Figure 4:
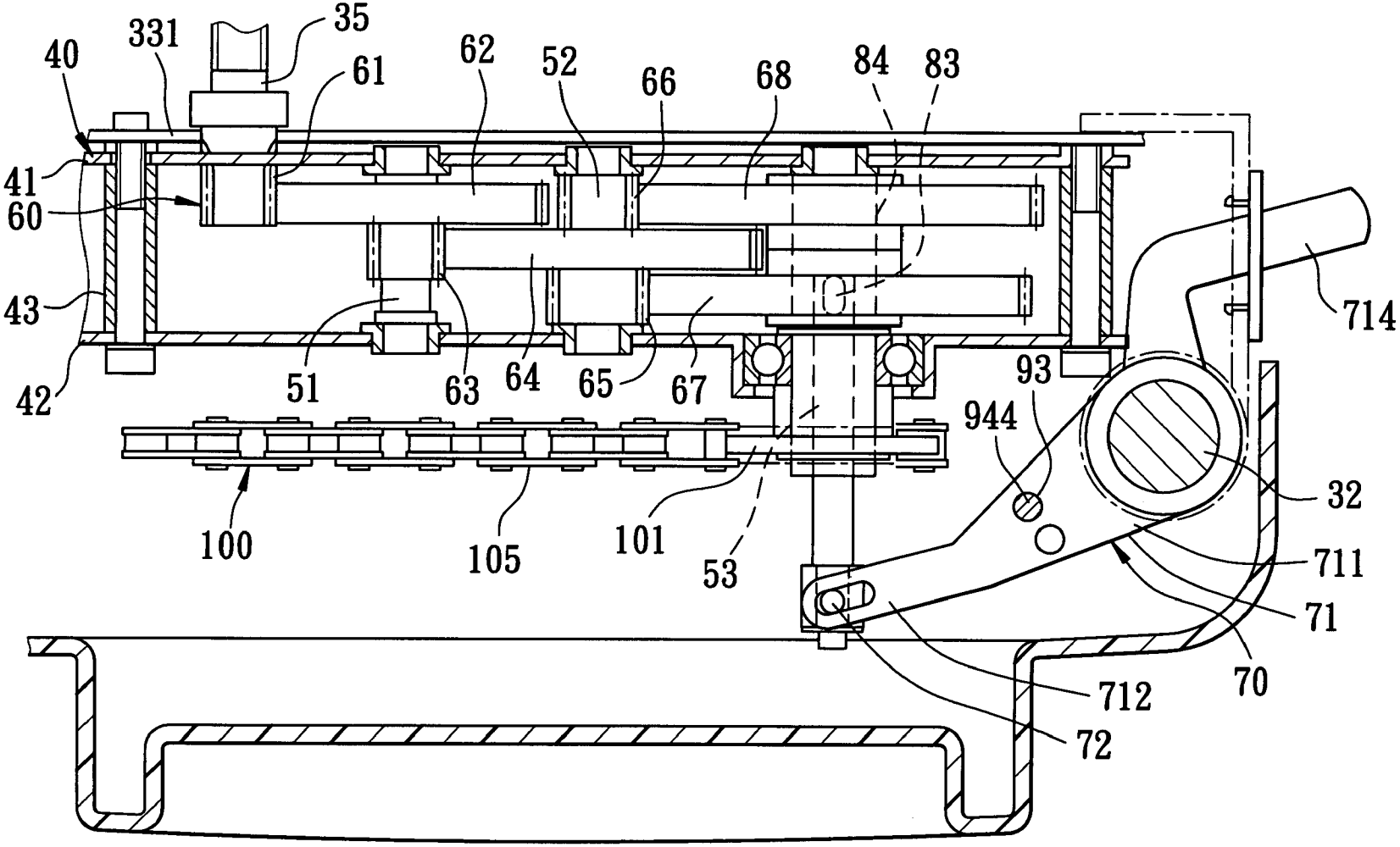
FIG. 4 is a schematic partly sectional view of the preferred embodiment, showing the clutch actuating shaft in a first position.
Figure 5:
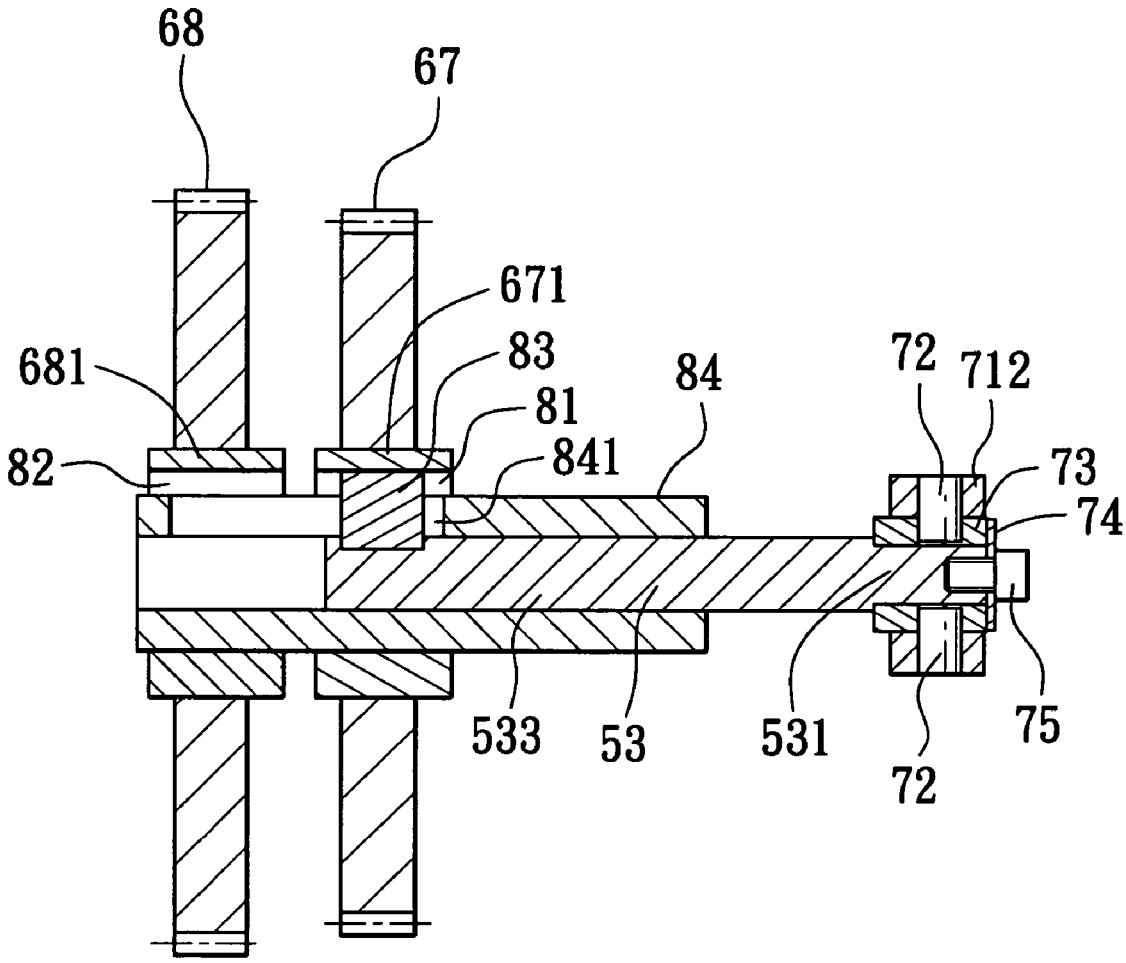
FIG. 5 is a schematic partly sectional view showing the clutch actuating shaft in the first position.

The clutch actuating shaft includes a shaft body 53 and a bearing tube 84. With reference to FIGS. 3 to 5, the shaft body 53 is mounted rotatably on the inside and outside plates 41,42, extends along the driving axis to be rotatable about the driving axis, and is surrounded by the first and second driven gears 67,68. The shaft body 53 includes a coupling segment 533 which is movable along the driving axis, and a smaller-diameter actuated end 531 which is opposite to the coupling segment 533 along the driving axis, and which is actuated to move the coupling segment 533 along the driving axis between first and second positions. The bearing tube 84 is interposed between the coupling segment 533 and the first and second driven gears 67,68.

Figure 6:
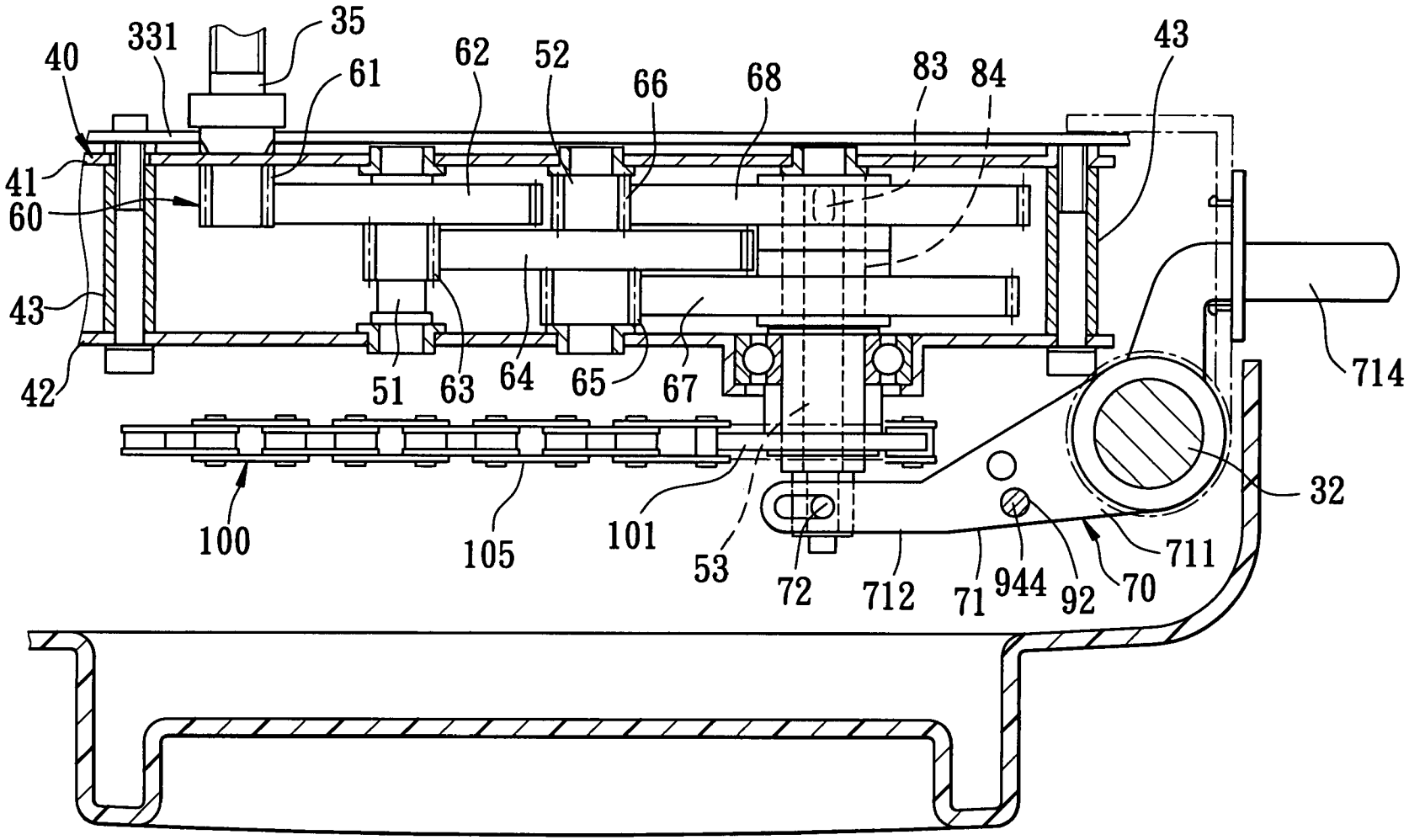
FIG. 6 is a schematic partly sectional view of the preferred embodiment, showing the clutch actuating shaft in a second position.
Figure 7:
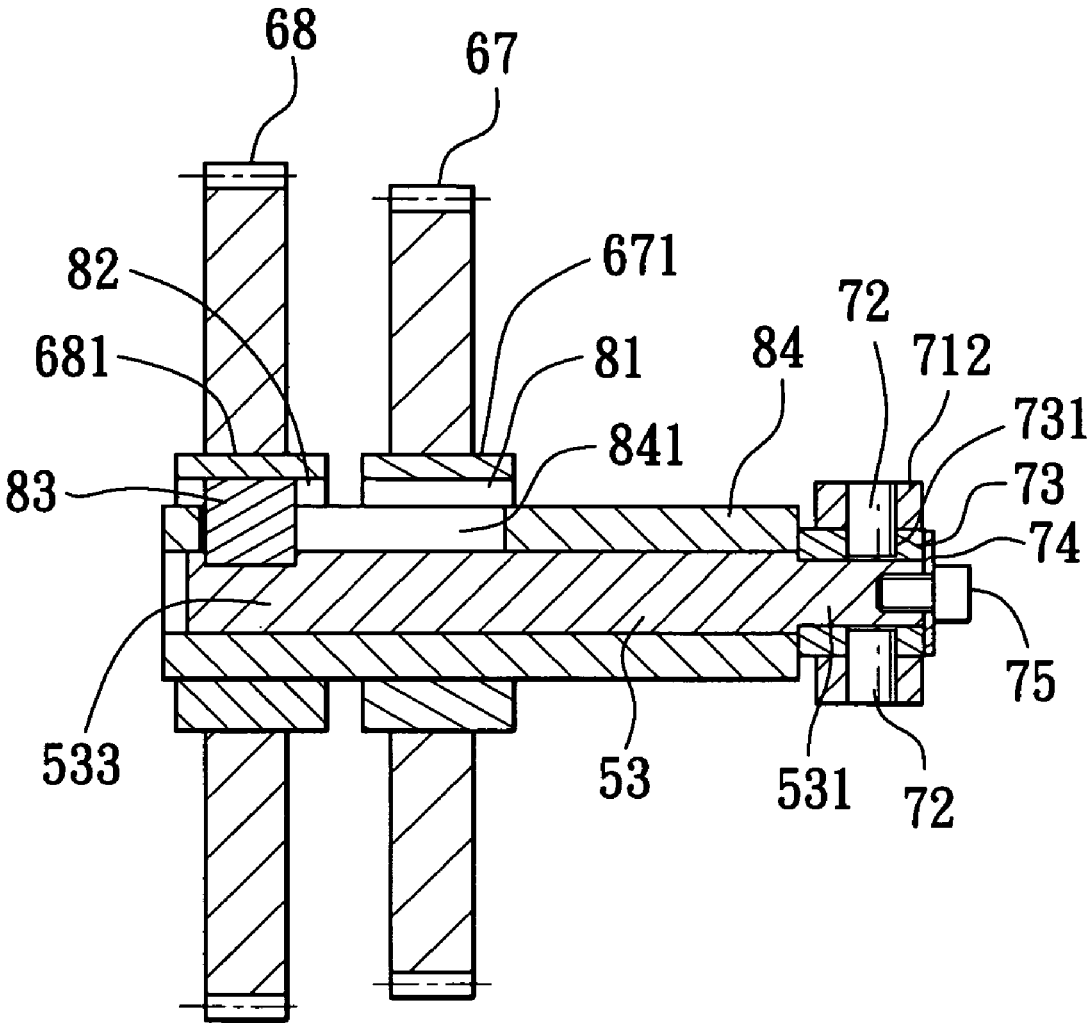
FIG. 7 is a schematic partly sectional view showing the clutch actuating shaft in the second position.
Figure 8:
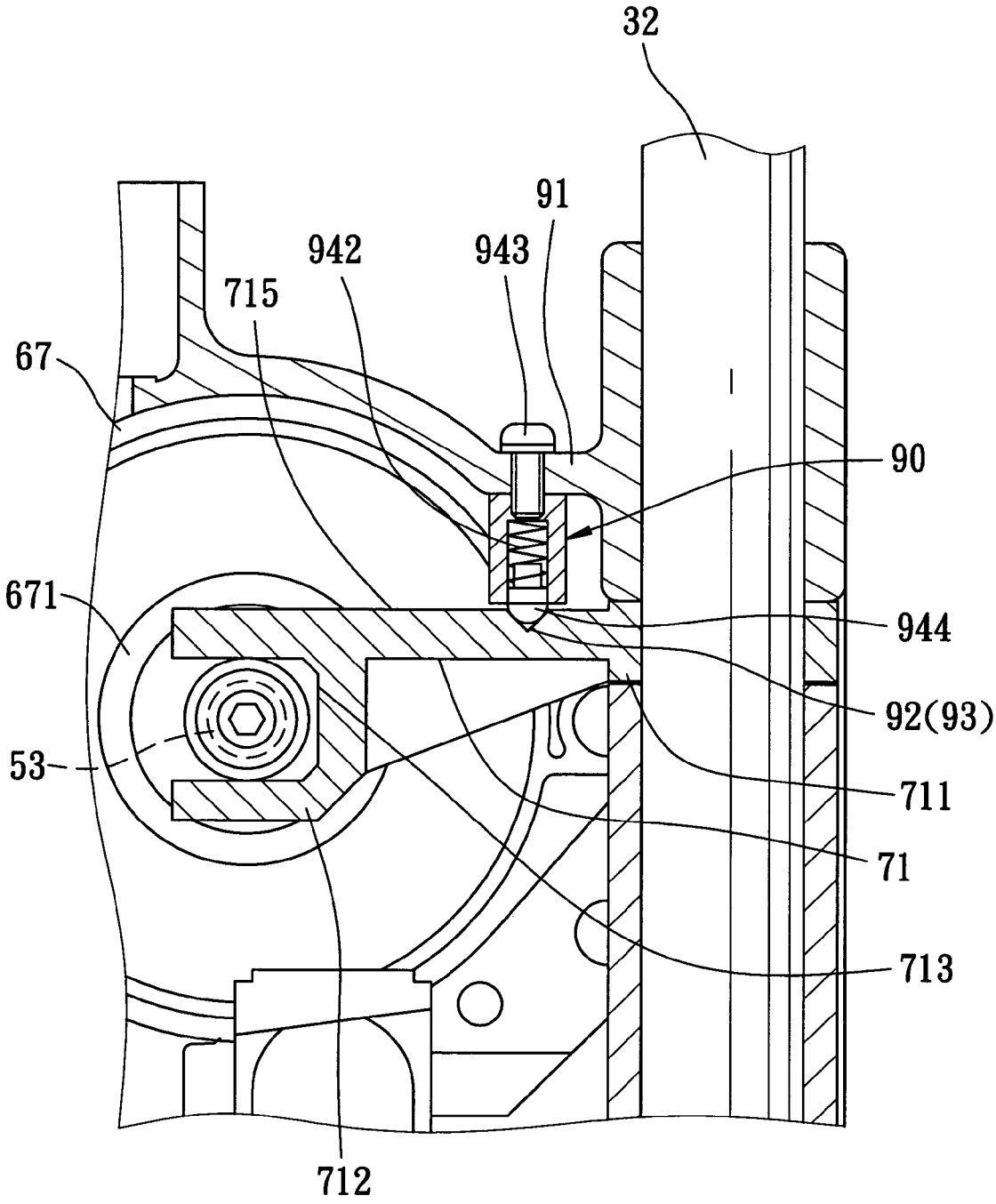
FIG. 8 is a fragmentary sectional view showing a shaft positioning member of the preferred embodiment.

The clutch member includes first and second grooves 81,82 which are formed respectively in central portions 671,681 of the first and second driven gears 67,68 and which confront and which are spaced apart from the coupling segment 533 of the shaft body 53 radially, and a boss 83 which is secured on and which radially extends from the coupling segment 533 of the shaft body 53, and which extends through a guiding slot 841 in the bearing tube 84 so that the bearing tube 84 is in splined engagement with the coupling segment 533 of the shaft body 53 by the boss 83 so as to enable the coupling segment 533 to be movable relative to the bearing tube 84 along the driving axis, and to permit rotation of the bearing tube 84 with the coupling segment 533 about the driving axis. Moreover, the guiding slot 841 defines a sliding axis parallel to the driving axis such that the boss 83 is slidable along the sliding axis to engage the first groove 81 when the coupling segment 533 of the shaft body 53 is placed in the first position so as to transmit the first reduction drive to drive the bearing tube 84 to rotate with a first rotational drive (see FIGS. 4 and 5), and to engage the second groove 82 when the coupling segment 533 of the shaft body 53 is placed in the second position so as to transmit the second reduction drive to drive the bearing tube 84 to rotate with a second rotational drive (see FIGS. 6 and 7).

Figure 2:
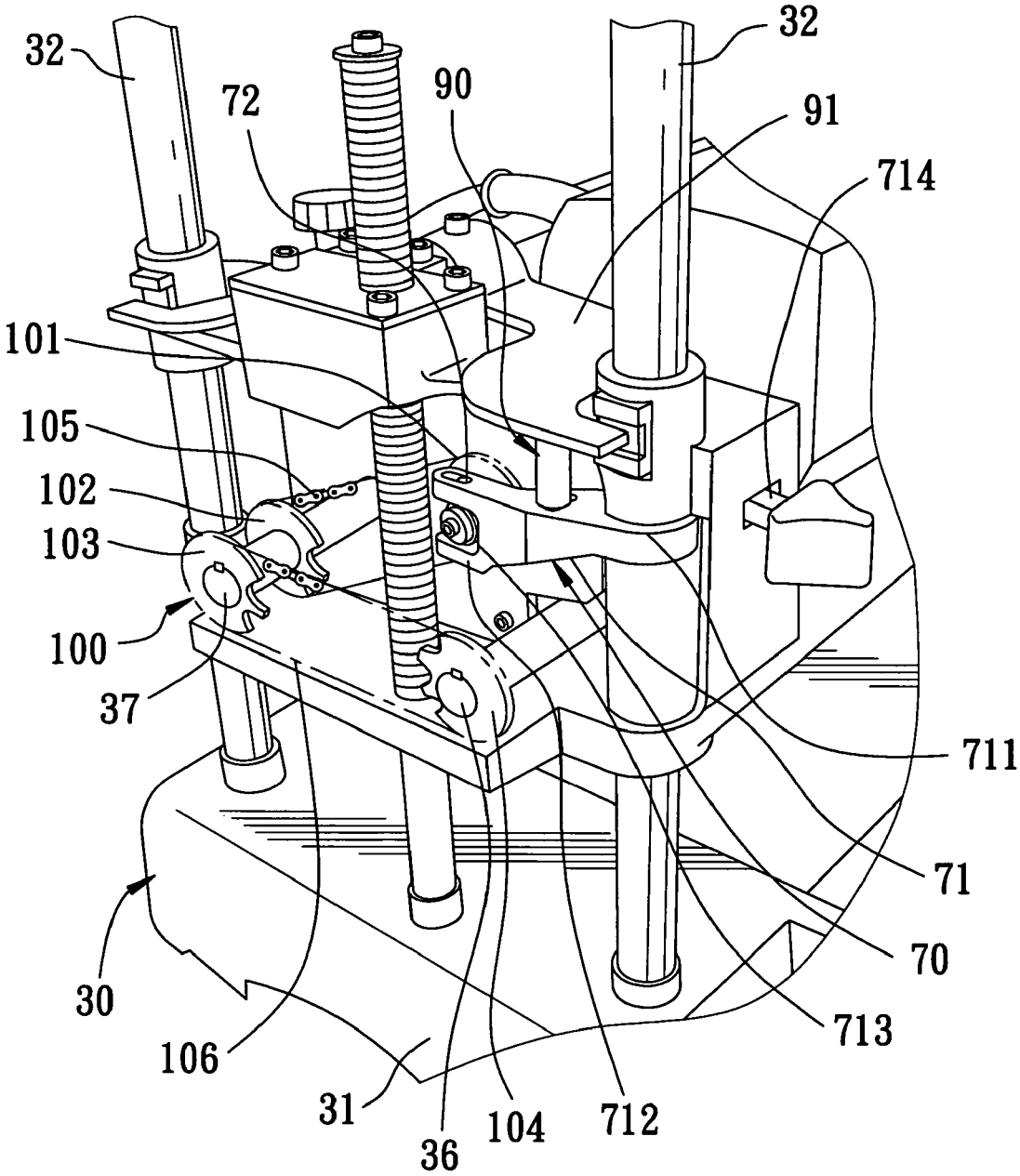
FIG. 2 is a perspective view of a shifting member, a clutch actuating shaft and a drive transmitting member of the preferred embodiment.

Referring to FIGS. 2 and 4, a drive transmitting member 100 includes a sprocket-and-chain mechanism which is disposed to transmit the first or second rotational drive of the bearing tube 84 to the front and rear feed rollers 36,37. In particular, the sprocket-and-chain mechanism includes first and second sprockets 101,102 which are mounted on and which are rotated with the bearing tube 84 and the rear feed roller 37, respectively, and which are trained by a first chain 105 so as to transmit the rotational force of the bearing tube 84 to the rear feed roller 37, and third and fourth sprockets 103,104 which are mounted on and which are rotated with the rear and front feed rollers 37,36, respectively, and which are trained by a second chain 106 such that the front and rear feed rollers 36,37 can rotate simultaneously by the rotational force of the bearing tube 84.

With reference to FIGS. 3 to 7, the shifting member 70 is disposed to shift the coupling segment 533 between the first and second positions. Specifically, the shifting member 70 includes an actuating lever 71 which is pivotally mounted on one of upright posts 32 of the mounting frame 30 at a fulcrum portion 711, and which has a weight end 712 turnable about the fulcrum portion 711 and coupled to the actuated end 531 of the shaft body 53 to shift the coupling segment 533 between the first and second positions, and a power end 714 disposed at an opposite side of the weight end 712 relative to the fulcrum portion 711 so as to be operated to turn the weight end 712 about the fulcrum portion 711. The weight end 712 has two prongs spaced apart from each other in the upright direction so as to define an opening 713 therebetween. A bearing 73 is received in the opening 713, and surrounds the actuated end 531 to permit rotation of the actuated end 531 relative to the bearing 73. A screw bolt 75 passes through a washer 74, and engages threadedly a screw hole 532 in the actuated end 531. A pair of pins 72 pass through the prongs of the weight end 712, and are inserted into two radially opposite holes 731 in the bearing 73 to retain the bearing 73 in the opening 713.

Figure 9:
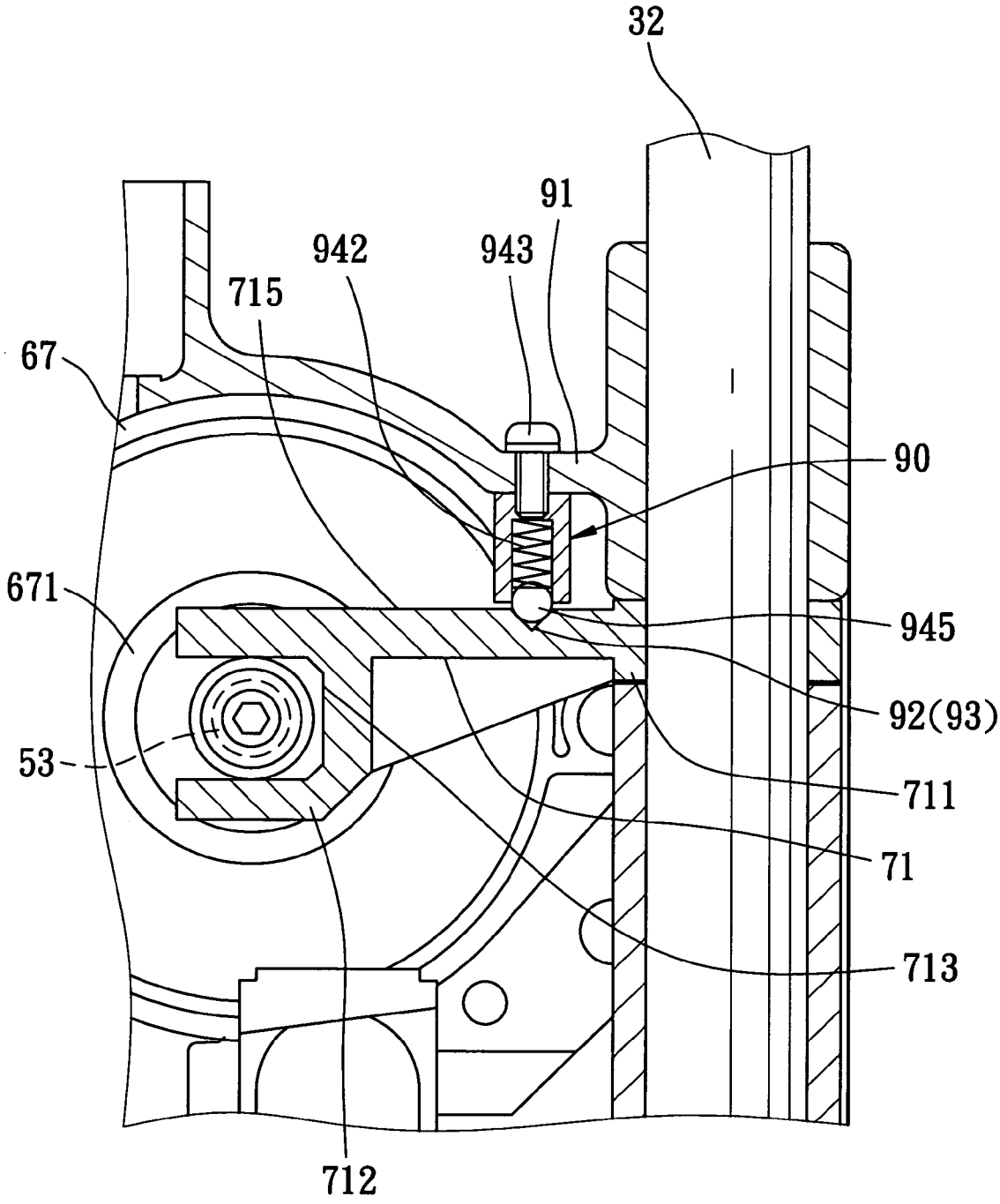
FIG. 9 is a fragmentary sectional view similar to FIG. 8, showing another type of the shaft positioning member.

Referring to FIGS. 2 to 4 and FIG. 8, the shaft positioning member 90 includes first and second depressions 93,92 which are formed in an upper surface 715 of the actuating lever 71, and which are angularly displaced from each other about the fulcrum portion 711, a connecting plate 91 which is secured to two of the upright posts 32 above the actuating lever 71, a sleeve 941 which is secured on the underside of the connecting plate 91 by a screw 943, and a retaining body 944 which is received in the sleeve 941 and which is biased by a spring 942 to engage one of the first and second depressions 93,92 to thereby position the coupling segment 533 of the shaft body 53 at a corresponding one of the first and second positions. In the embodiment shown in FIG. 8, the retaining body 944 is a pin. Alternatively, as shown in FIG. 9, the retaining body is a ball 945.

Referring to FIGS. 1, 2, 4 and 5, when the power end 714 is turned close to the motor 34 to move the coupling segment 533 of the shaft body 53 to the first position, the boss 83 is engaged in the first groove 81 to permit rotation of the first driven gear 67 with the first rotational drive, thereby permitting rotation of the front and rear feed rollers 36,37 at a first rotational speed. On the contrary, referring to FIGS. 6 and 7, when the power end 714 is turned away from the motor 34 to move the coupling segment 533 to the second position, the boss 83 is engaged in the second groove 82 to permit rotation of the second driven gear 68 with the second rotational drive, thereby permitting rotation of the front and rear feed rollers 36,37 at a second rotational speed.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A drive shiftable rolling feed device for a wood planing machine which includes a mounting frame having right and left frame sides spaced apart from each other in a longitudinal direction, a support carriage mounted on the right and left frame sides and movable in an upright direction, a motor with an output shaft that is disposed on the support carriage, and a cutter shaft rotatably mounted on the support carriage, extending in the longitudinal direction, and driven by the output shaft of the motor so as to deliver a primary drive, said device comprising:

front and rear feed rollers adapted to be mounted on the support carriage at two opposite sides of the cutter shaft in a transverse direction relative to both the longitudinal direction and the upright direction, each of said front and rear feed rollers being rotatable about a roller axis in the longitudinal direction;

first and second driven gears which are adapted to be mounted on and which are rotatable relative to the support carriage about a driving axis parallel to the roller axis, and which are spaced apart from each other along the driving axis;

a reduction gear train adapted to convert the primary drive into first and second reduction drives, said reduction gear train being coupled to said first and second driven gears to deliver the first and second reduction drives to said first and second driven gears, respectively;

a clutch actuating shaft which is adapted to be mounted rotatably on the support carriage, which extends along the driving axis, and which is surrounded by said first and second driven gears, said clutch actuating shaft including a coupling segment which is movable along the driving axis relative to the support carriage, and an actuated end opposite to said coupling segment along the driving axis and actuated to move said coupling segment along the driving axis between first and second positions;

a clutch member disposed to couple said coupling segment to said first driven gear when said coupling segment is in the first position so as to transmit the first reduction drive to drive said clutch actuating shaft to rotate with a first rotational drive, and to couple said coupling segment to said second driven gear when said coupling segment is in the second position so as to transmit the second reduction drive to drive said clutch actuating shaft to rotate with a second rotational drive;

a drive transmitting member disposed to transmit the first or second rotational drive of said clutch actuating shaft to said front and rear feed rollers; and a shifting member coupled to said actuated end to shift said coupling segment between the first and second positions.

2. The drive shiftable rolling feed device of claim 1, wherein said clutch member includes first and second grooves which are formed in said first and second driven gears and which confront and which are spaced apart from said coupling segment radially, and a boss which is secured on and which extends radially from said coupling segment so as to be moved in the longitudinal direction to engage said first groove when said coupling segment is placed in the first position, and to engage said second groove when said coupling segment is placed in the second position.

3. The drive shiftable rolling feed device of claim 2, wherein said clutch actuating shaft includes a bearing tube which is interposed between said coupling segment and said first and second driven gears, and which is in splined engagement with said coupling segment by said boss such that said coupling segment is movable relative to said bearing tube along the driving axis, and such that said bearing tube is rotated with said coupling segment about the driving axis, said drive transmitting member including a sprocket-and-chain mechanism which couples said bearing tube to said front and rear feed rollers to rotate simultaneously said front and rear feed rollers.

4. The drive shiftable rolling feed device of claim 3, wherein said bearing tube has a guiding slot which defines a sliding axis parallel to the driving axis and which permits said boss to extend therethrough and to be slidable along the sliding axis.

5. The drive shiftable rolling feed device of claim 1, wherein said shifting member includes an actuating lever which is adapted to be pivotally mounted on the mounting frame at a fulcrum portion, and which has a weight end turnable about said fulcrum portion and coupled to said actuated end of said clutch actuating shaft to shift said coupling segment between the first and second positions, and a power end disposed at an opposite side of said weight end relative to said fulcrum portion so as to be operated to turn said weight end about said fulcrum portion.

6. The drive shiftable rolling feed device of claim 5, wherein said weight end has two prongs spaced apart from each other in the upright direction so as to define an opening therebetween, said shifting member further includes a bearing which is received in said opening and which surrounds said actuated end to permit rotation of said actuated end relative to said bearing, and a pair of pins, each of which passes through a respective one of said prongs and which is inserted into said bearing to retain said bearing in said opening.

7. The drive shiftable rolling feed device of claim 5, further comprising a shaft positioning member that includes first and second depressions which are formed in said actuating lever, and which are angularly displaced from each other about said fulcrum portion, and a spring-biased retaining body which is biased to engage in one of said first and second depressions so as to position said coupling segment at a corresponding one of the first and second positions.

8. The drive shiftable rolling feed device of claim 7, wherein said retaining body is a pin.

9. The drive shiftable rolling feed device of claim 7, wherein said retaining body is a ball.

* * * * *